US008746273B2

(12) United States Patent
Yang et al.

(10) Patent No.: US 8,746,273 B2
(45) Date of Patent: Jun. 10, 2014

(54) PLASTIC FAUCET BODY WITH COPPER CONNECTING LEGS

(71) Applicant: Globe Union Industrial Corp., Taichung (TW)

(72) Inventors: Chaota Yang, Taichung (TW); Chiahua Yuan, Taichung (TW); Yiping Lin, Taichung (TW); Shengping Hu, Guangdong (CN)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 13/753,644

(22) Filed: Jan. 30, 2013

(65) Prior Publication Data

US 2014/0069519 A1 Mar. 13, 2014

Related U.S. Application Data

(63) Continuation of application No. 13/714,533, filed on Dec. 14, 2012.

(30) Foreign Application Priority Data

Sep. 7, 2012 (CN) ..... 2012 2 0455548

(51) Int. Cl.
*F16K 5/00* (2006.01)
*F16K 27/06* (2006.01)
*E03C 1/04* (2006.01)

(52) U.S. Cl.
USPC ..... 137/315.12; 137/328; 137/801; 4/675

(58) Field of Classification Search
USPC ..... 137/801, 624.4, 624.41, 328, 315.12; 4/775–778
See application file for complete search history.

(56) References Cited

U.S. PATENT DOCUMENTS

| | | | | |
|---|---|---|---|---|
| 7,231,936 | B2 * | 6/2007 | Chang | 137/328 |
| 2007/0157981 | A1 * | 7/2007 | Burns et al. | 137/801 |
| 2009/0184513 | A1 * | 7/2009 | Avnon | 285/24 |
| 2010/0096034 | A1 * | 4/2010 | Hou | 137/801 |

FOREIGN PATENT DOCUMENTS

CN 101664980 A 3/2010

* cited by examiner

*Primary Examiner* — John K Fristoe, Jr.
*Assistant Examiner* — Kevin Barss
(74) *Attorney, Agent, or Firm* — Alan Kamrath; Kamrath IP Lawfirm, P.A.

(57) ABSTRACT

A plastic faucet body with copper connecting legs contains a plastic member including two seat portions, a connecting portion having at least one exit and a tunnel, and two support feet, each having an inlet and a channel; two copper connecting legs engaged on the two support feet. A bottom end portion of each copper connecting leg beyond a bottom end of the each support foot forms a distance so that between the each copper connecting leg and the each support foot is defined a receiving chamber. A lower coupling portion forms on a connection zone of the each support foot and the each copper connecting leg. A groove communicates with the receiving chamber and the lower coupling portion. A seal element is retained with the groove to stop cold water from the cold water pipe or hot water from the hot water pipe flowing into the lower coupling portion.

7 Claims, 10 Drawing Sheets

PLASTIC FAUCET BODY WITH COPPER CONNECTING LEGS

This application is a Continuation-in-Part of application Ser. No. 13/714,533, filed Dec. 14, 2012.

BACKGROUND OF THE INVENTION

1. Field of the Invention

The present invention relates to a plastic faucet body with copper connecting legs.

2. Description of the Prior Art

Conventional faucet comprises a faucet body, and more particularly to a H-shaped faucet body with two inlets. This H-shaped faucet body comprises two seat portions mounted on two sides thereof, a connecting portion defined between the two seat portions, and two support feet extending downwardly from two bottom ends of the two seat portions. Each support foot has an inlet formed on a bottom end thereof for flowing cold water or hot water and has a channel for communicating with each seat portion. The each seat portion is used to receive a valve member controlled by a handle. The connecting portion has at least one outlet defined on a middle section thereof so as to connect with a water pipe or a shower via a hole.

To fix the faucet body, each support foot has outer threads molded on an outer surface thereof so as to screw with a washbasin by ways of a nut, and then a cover is covered in the washbasin, thus connecting the faucet body.

It is well known that the handle is provided to control the valve member so that the hot water and the cold water flow into the at least one outlet at a desired ratio, thus controlling water temperature.

Conventional faucet body is casting molded from copper material, so sand core and sand mold are required prior to casting mold the faucet body, and copper liquid is poured, finally the sand core is removed. In addition, the faucet body is machined, including reaming, drilling, and milling. But the machining process is complicated and takes a long time. Likewise, the tools for machining the faucet body are damaged easily, and the faucet body is casting molded from copper material, thereby casing high production cost.

A conventional integrally plastic faucet body and a method for making thereof are disclosed in CN Publication No. 101664980. A faucet body is overmolded from plastic material, and two support feet are made of plastic material, wherein each support foot has a toothed component or a copper leg insert molded from copper material, thus producing the faucet body made of copper material and plastic material. However, a slit generates on a connection zone of the copper leg and the support foot, thus leaking water and having water pollution.

The present invention has arisen to mitigate and/or obviate the afore-described disadvantages.

SUMMARY OF THE INVENTION

The primary object of the present invention is to provide a plastic faucet body with copper connecting legs which is capable of overcoming the shortcomings of the conventional plastic faucet body with copper connecting legs.

To obtain the above objectives, a plastic faucet body with copper connecting legs provided by one embodiment of the present invention contains:

a plastic member injection molded from plastic material and including two seat portions mounted on two sides thereof, a connecting portion defined between the two seat portions, and two support feet extending downwardly from two bottom ends of the two seat portions; each support foot having an inlet formed on a bottom end thereof and a channel arranged in the each support foot and communicating with each seat portion; the connecting portion having at least one exit defined on a middle section thereof and having a tunnel defined therein and communicating with the each seat portion;

two copper connecting legs made of cooper material, and each copper connecting leg being engaged on an outer wall of the each support foot of the plastic member and having a threaded section formed on the outer wall thereof; characterized in that:

a bottom end portion of the each copper connecting leg beyond a bottom end of the each support foot forms a distance so that between an inner fence of the each copper connecting leg and the bottom end of the each support foot is defined a receiving chamber for receiving a distal end of a cold water pipe or a distal end of a hot water pipe;

a lower coupling portion forms on a connection zone of the bottom end of the each support foot and the inner wall of the each copper connecting leg;

a groove communicates with the receiving chamber and connects with the lower coupling portion;

a seal element is retained with the groove so as to stop cold water from the cold water pipe or hot water from the hot water pipe flowing into the lower coupling portion.

In addition, a plastic faucet body with copper connecting legs provided by another embodiment of the present invention contains:

a plastic member injection molded from plastic material and including two seat portions mounted on two sides thereof, a connecting portion defined between the two seat portions, and two support feet extending downwardly from two bottom ends of the two seat portions; each support foot having an inlet formed on a bottom end thereof and a channel arranged in the each support foot and communicating with each seat portion; the connecting portion having at least one exit defined on a middle section thereof and having a tunnel defined therein and communicating with the each seat portion;

two copper connecting legs made of cooper material, and each copper connecting leg being engaged on an outer wall of the each support foot of the plastic member and having a threaded section formed on the outer wall thereof; characterized in that:

a bottom end portion of the each copper connecting leg beyond a bottom end of the each support foot forms a distance so that between an inner fence of the each copper connecting leg and the bottom end of the each support foot is defined a receiving chamber for receiving a distal end of a cold water pipe or a distal end of a hot water pipe;

a lower coupling portion forms on a connection zone of the bottom end of the each support foot and the inner wall of the each copper connecting leg;

at least one groove is defined on an upper side and a lower side of an external peripheral face of the each support foot relative to an inner fence of each copper connecting leg;

the each copper connecting leg is fitted with the each support foot, after the seal element is retained in each groove such that cold water from the cold water pipe or hot water from the hot water pipe is stopped from flowing into the lower coupling portion.

Thereby, the lower coupling portion of the connection zone of the each support foot and the inner wall of the each copper connecting leg is moved to an upper position, such that receiving chamber is defined on the inner fence of the each copper connecting leg so as to receive the cold water pipe or the hot water pipe, and one groove is formed so as to retain the seal element and to stop the cold water from the cold water pipe or the hot water from the hot water pipe flowing into the lower coupling portion, thus avoiding water pollution. In addition, the each copper connecting leg can be also fitted with the each support foot, after the seal element is retained in each groove so as to stop water, which flows into the lower coupling portion, leaking outwardly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

FIGS. 1-4 show a plastic faucet body with copper connecting legs according to a first embodiment of the present invention. A faucet body 1 comprises a plastic member 10 and two copper connecting legs 20.

Figure 1:
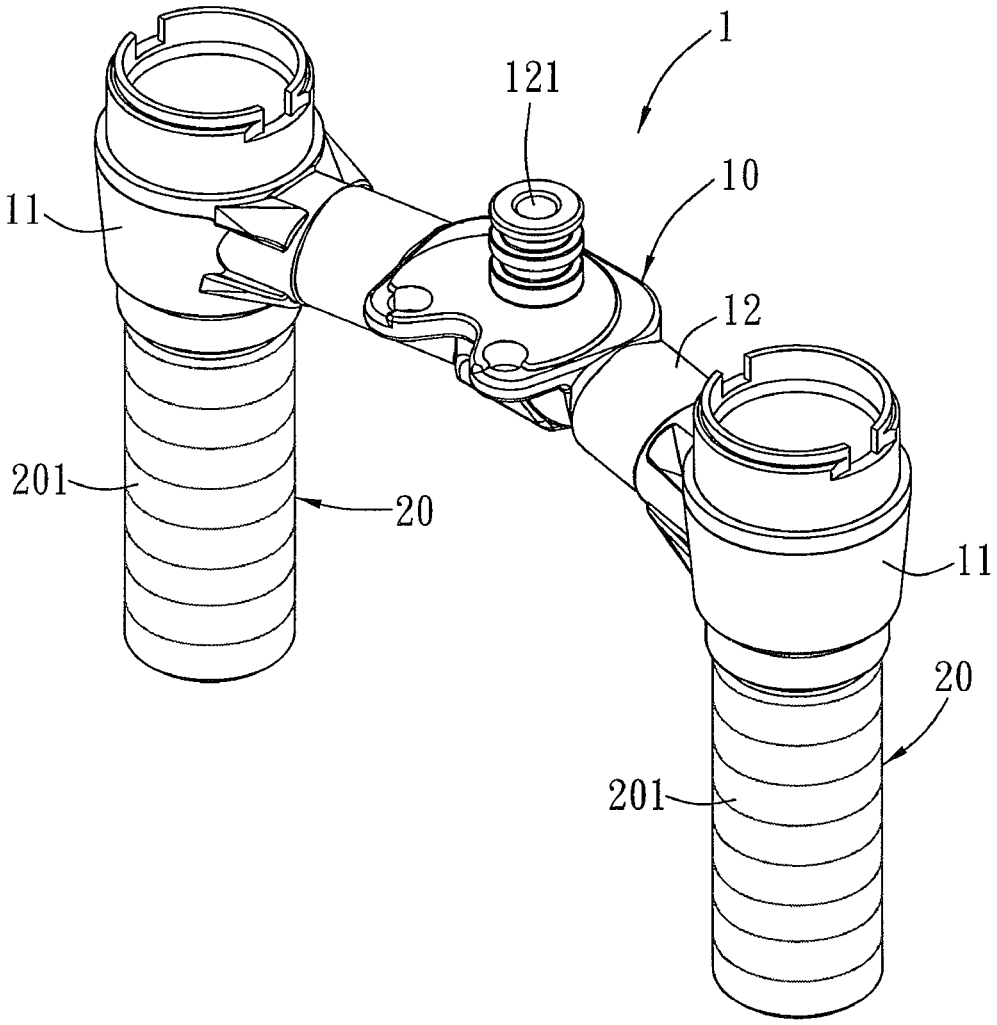
FIG. 1 is a perspective view showing the assembly of a plastic faucet body with copper connecting legs according to a first embodiment of the present invention.
Figure 2:
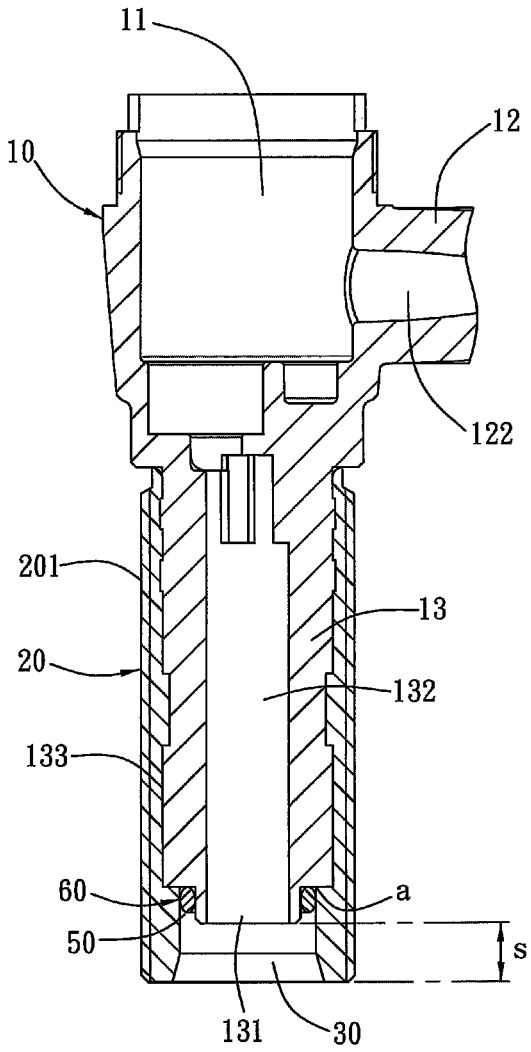
FIG. 2 is a cross sectional view showing the assembly of a part of the plastic faucet body with the copper connecting legs according to the first embodiment of the present invention.
Figure 3:
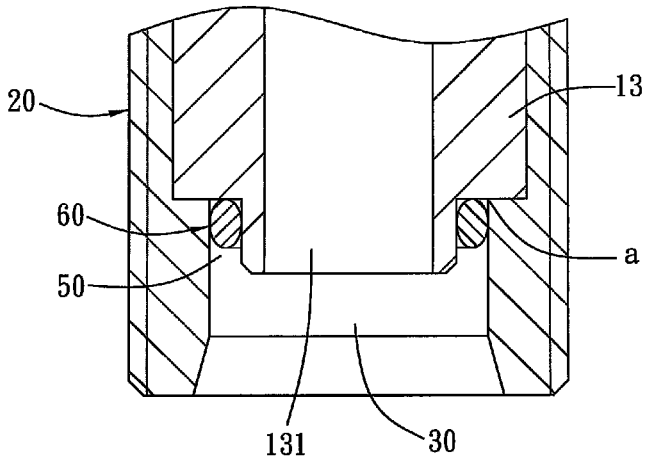
FIG. 3 is a partial cross sectional view showing the assembly of a faucet body and a seal element according to the first embodiment of the present invention.
Figure 4:
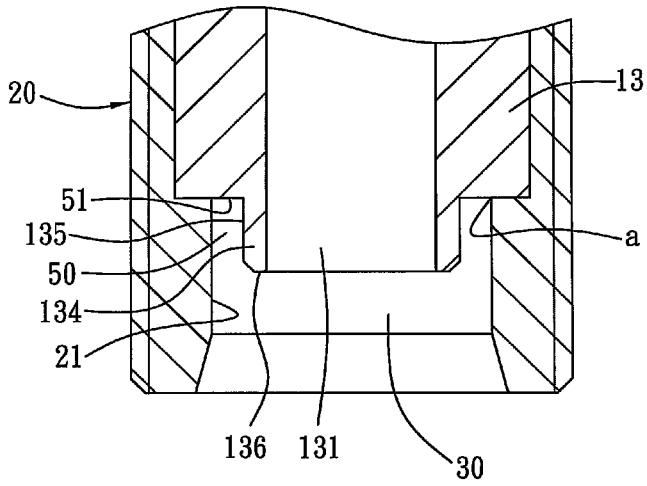
FIG. 4 is a partial cross sectional view showing the operation of the plastic faucet body with the copper connecting legs according to the first embodiment of the present invention.

The plastic member 10 is injection molded from plastic material and includes two seat portions 11 mounted on two sides thereof, a connecting portion 12 defined between the two seat portions 11, and two support feet 13 extending downwardly from two bottom ends of the two seat portions 11. As shown in FIG. 4, each support foot 13 has an inlet 131 formed on a bottom end thereof and has a channel 132 arranged in the each support foot 13 and communicating with each seat portion 11. The connecting portion 12 has at least one exit 121 defined on a middle section thereof and has a tunnel 122 defined therein and communicating with the each seat portion 11.

The two copper connecting legs 20 are made of cooper material, and each copper connecting leg 20 is engaged on an outer wall of the each support foot 13 of the plastic member 10 and has a threaded section 201 formed on the outer wall thereof.

Figure 5:
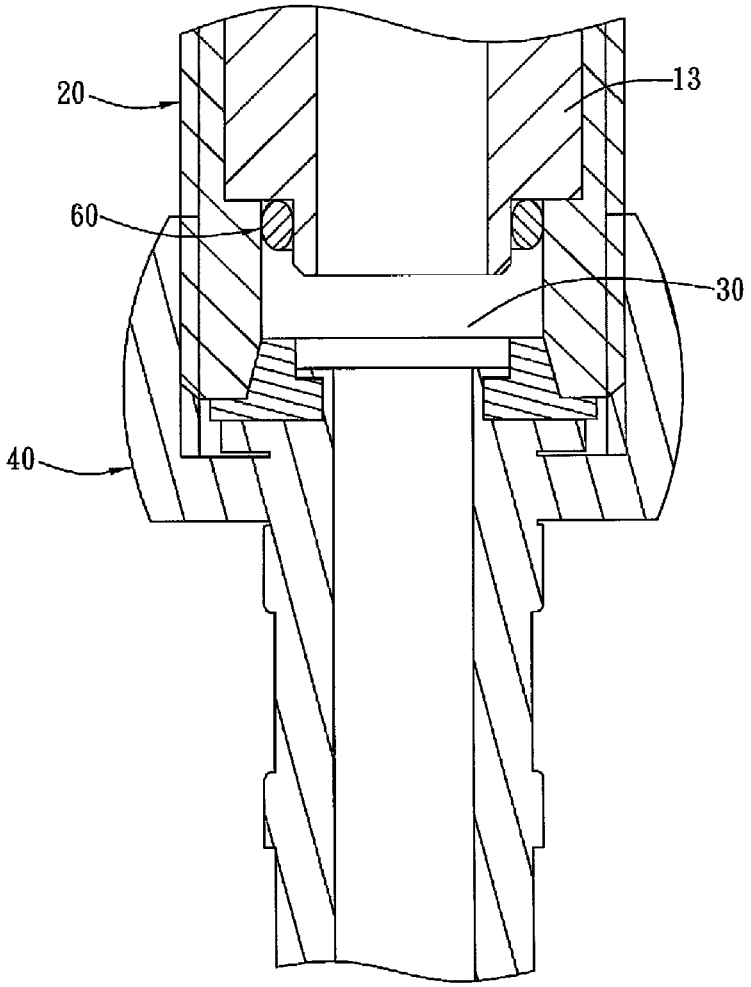
FIG. 5 is a cross sectional view showing the assembly of a wedged connecting pipe according to the first embodiment of the present invention.

An improvement of the plastic faucet body of the present invention contains:

a bottom end portion of the each copper connecting leg 20 beyond a bottom end of the each support foot 13 forming a distance S so that between an inner fence 21 of the each copper connecting leg 20 and the bottom end of the each support foot 13 being defined a receiving chamber 30 for receiving a distal end of a cold water pipe or a distal end of a hot water pipe 40, as illustrated in FIG. 5;

a lower coupling portion a formed on a connection zone of the bottom end of the each support foot 13 and the inner wall of the each copper connecting leg 20;

a groove 50 communicating with the receiving chamber 30 and connecting with the lower coupling portion a;

a seal element 60 retained with the groove 50 so as to stop cold water from the cold water pipe or hot water from the hot water pipe 40 flowing into the lower coupling portion a;

the each support foot 13 having a stepped fitting portion 134 formed on a bottom end thereof, and the stepped fitting portion 134 having a diameter smaller than that of the each support foot 13; an outer fence 135 of the stepped fitting portion 134 and the inner fence 21 of the each copper connecting leg 20 defining a part of the groove 50, and the lower coupling portion a located at a bottom fence 51 of the groove 50;

the seal element 60 being an O ring made of rubber material, and the seal element 60 having an external rim 61 contacting with an outer fringe 135 of the stepped fitting portion 134 and an external periphery 62 retaining with the inner fence 21 of the each copper connecting leg 20.

In this embodiment, the seal element 60 is retained in the groove 50 so as to stop the cold water from the cold water pipe or the hot water from the hot water pipe 40 flowing into the lower coupling portion a and flowing out of the connection zone of the each support foot 13 and the each copper connecting leg 20.

Figure 6:
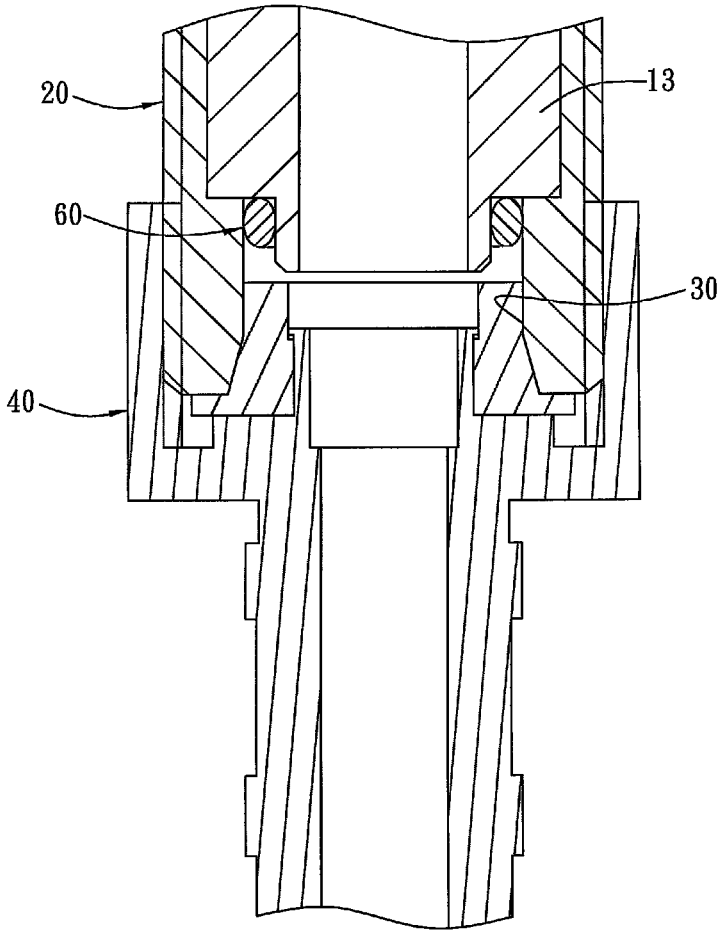
FIG. 6 is a cross sectional view showing the assembly of a flat connecting pipe according to the first embodiment of the present invention.
Figure 7:
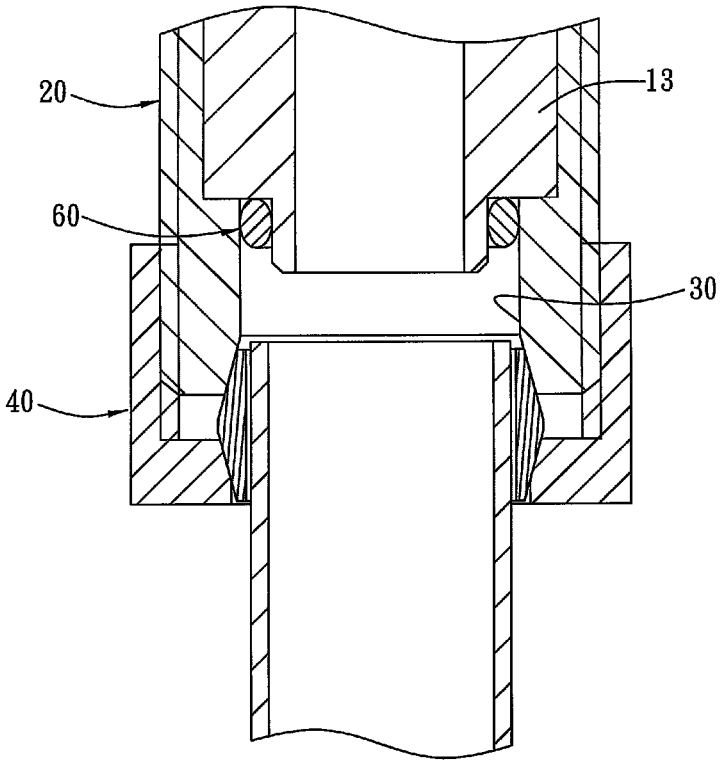
FIG. 7 is a cross sectional view showing the assembly of a compressed nut connecting pipe according to the first embodiment of the present invention.

It is to be noted that the faucet body 1 is provided to couple with three kinds of cold water pipes or hot water pipes 40. A first kind of cold water pipe or hot water pipe 40 is a wedged connecting pipe 40 as shown in FIG. 5. A second kind of cold water pipe or hot water pipe 40 is a flat connecting pipe 40 as shown in FIG. 6. A third kind of cold water pipe or hot water pipe 40 is a compressed nut connecting pipe 40 as shown in FIG. 7. Between the inner fence 21 of the each copper connecting leg 20 and the bottom end of the each support foot 13 is defined the receiving chamber 30 so as to receive the three kinds of cold water pipe or hot water pipe 40.

Figure 8:
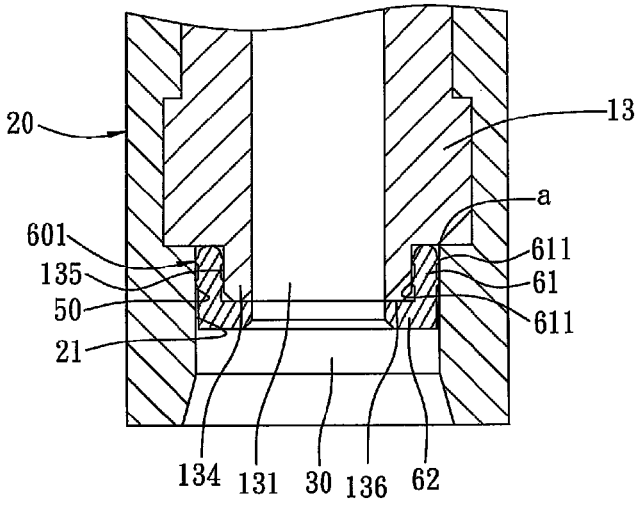
FIG. 8 is a partial cross sectional view showing the assembly of a faucet body and a seal element according to a second embodiment of the present invention.

Referring further to FIG. 8, a difference of a plastic faucet body with copper connecting legs of a second embodiment from that of the first embodiment comprises: a seal element 601 having a plug portion 61 and a lip fringe 62 integrally extending outward from one end of the plug portion 61; two annular ribs 611 extending outwardly from an inner wall and an outer wall of the plug portion 61 so that when the plug portion 61 retains in the groove 50, the two annular ribs 611 contact with the outer fence 135 of the stepped fitting portion 134 and the inner fence 21 of the each copper connecting leg 20, thus obtaining a sealing effect. The lip fringe 62 abuts against a wall face 136 of a distal end of the each support foot 13 so as to achieve a limiting effect and to replace the seal element 601 easily via the lip fringe 62. Preferably, the seal element 601 is made of rubber material.

Figure 9:
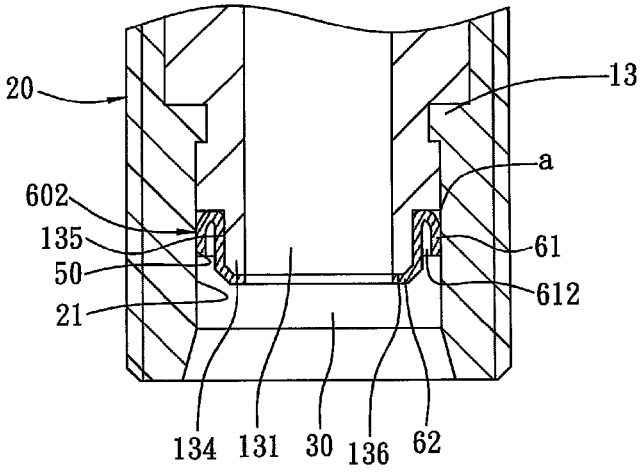
FIG. 9 is a partial cross sectional view showing the assembly of a faucet body and a seal element according to a third embodiment of the present invention.

As shown in FIG. 9, a difference of a plastic faucet body with copper connecting legs of a third embodiment from that of the second embodiment comprises: a plug portion 61 of a seal element 602 having a trough 612 defined on a bottom end thereof so that a cross section of the plug portion 61 is curved, and a thickness of the lip fringe 62 is thinner, such that the plug portion 61 radially retracts and expands so as to obtain the sealing effect. The plug portion 61 of the third embodiment does not have the two annular ribs 611 of the plug portion 61 of the second embodiment.

Figure 10:
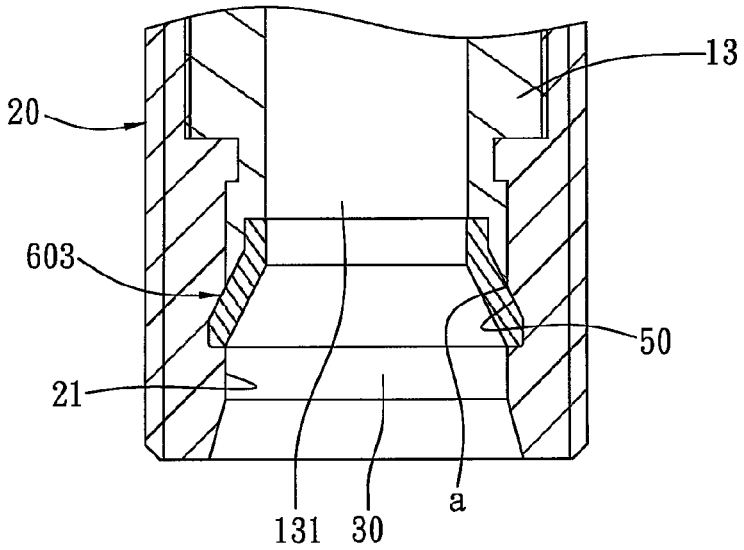
FIG. 10 is a partial cross sectional view showing the assembly of a faucet body and a seal element according to a fourth embodiment of the present invention.
Figure 11:
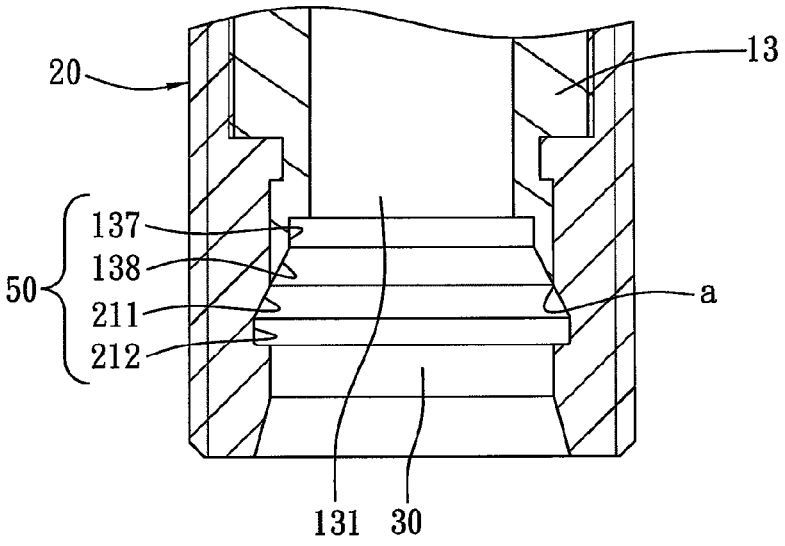
FIG. 11 is a partial cross sectional view showing the operation of the plastic faucet body with the copper connecting legs according to the fourth embodiment of the present invention.

As shown in FIGS. 10 and 11, a difference of a plastic faucet body with copper connecting legs of a fourth embodiment from those of the first embodiment to the third embodiment comprises: a first slot 137 formed on an inner wall of an inlet 131 of each of two support feet 13 and a first increased conical notch 138 connecting with a lower side of the first slot 137; a second increased conical notch 211 defined on an inner fence 21 of each copper connecting leg 20 so as to align with the first increased conical notch 138 and a second slot 212 coupling with a lower side of the second increased conical notch 211; the first slot 137, the first increased conical notch 138, the second increased conical notch 211, and the second slot 212 forming a groove 50; a lower coupling portion a formed on a connection zone of the first increased conical notch 138 and the second increased conical notch 211. A seal element 603 of the fourth embodiment is made of rubber material and becomes increased downwardly and retains in the groove. Thereby, the seal element 603 contacts with the lower coupling portion a so as to stop cold water from the cold water pipe or to stop hot water from the hot water pipe 40 flowing into the lower coupling portion a.

Figure 12:
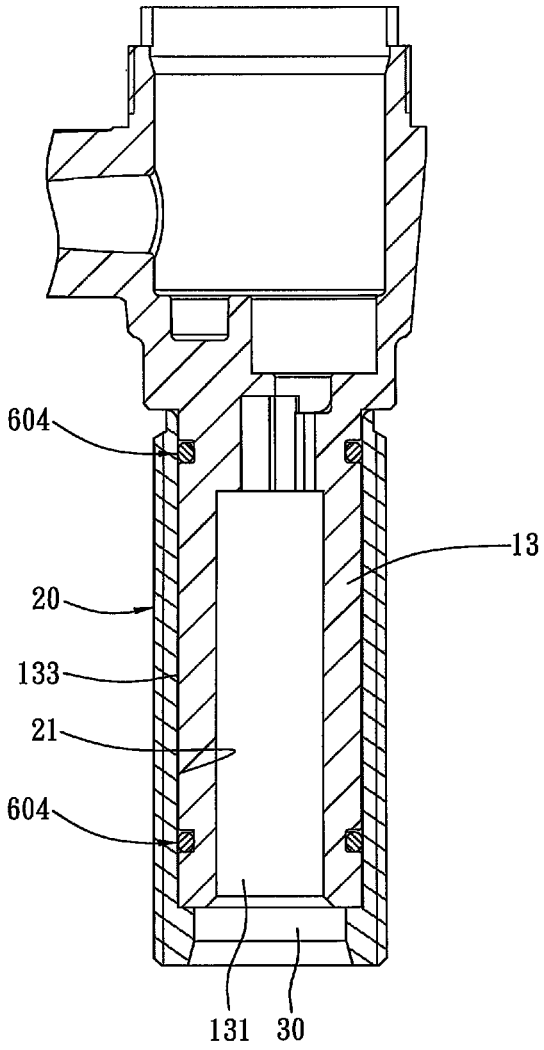
FIG. 12 is a cross sectional view showing the assembly of a part of the plastic faucet body with the copper connecting legs according to a fifth embodiment of the present invention.
Figure 13:
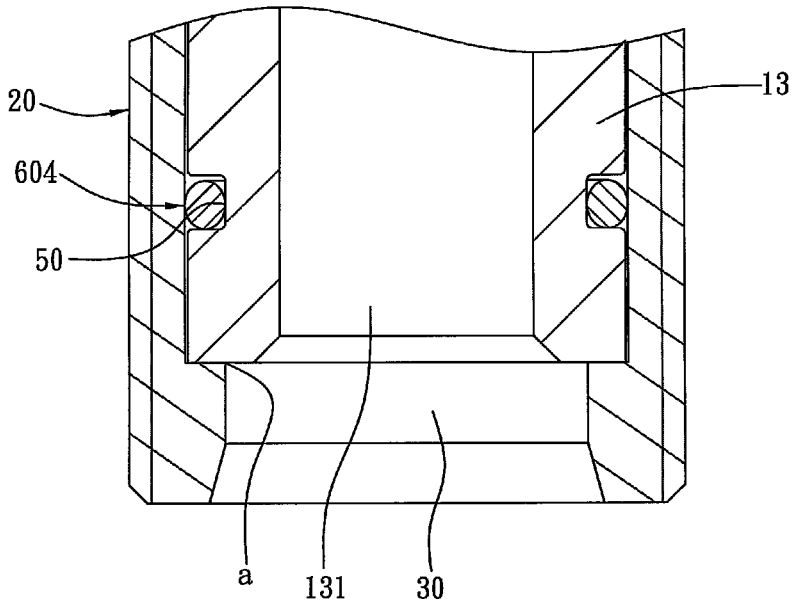
FIG. 13 is a partial cross sectional view showing the assembly of a faucet body and a seal element according to the fifth embodiment of the present invention.

As illustrated in FIGS. 12 and 13, a plastic faucet body with copper connecting legs of a fifth embodiment comprises a seal element 604 being an O ring made of rubber material, and two grooves 50 defined on an upper side and a lower side of an external peripheral face 133 of the each support foot 13 relative to an inner fence 21 of each copper connecting leg 20. i.e., a connection area of an external peripheral face 133 of the each support foot 13 and the inner fence 21 of the each copper connecting leg 20. It is to be noted that the each copper connecting leg 20 of the fifth embodiment is fitted with the each support foot 13, after the seal element 604 is retained in each groove 50. In other words, the seal elements 60, 601, 602, 603 of the first, the second, the third, and the fourth embodiments are fixed after the each copper connecting leg 20 is overmolded on the each support foot 13. In addition, a number of the seal element 604 is one or more than one so that cold water from the cold water pipe or hot water from the hot water pipe 40 is stopped from flowing into the lower coupling portion a. To prevent the each copper connecting leg 20 and the each support foot 13 of the first embodiment or the fourth embodiment from rotation in installation, an anti-rotation structure is defined between the each copper connecting leg 20 and the each support foot 13, and the anti-rotation structure contains a plurality of longitudinal toothed recesses arranged around the inner fence 21 of the each copper connecting leg 20 so that two external peripheral faces 133 of the two support feet 13 overmold with each other so as to form the anti-rotation structure, thus limiting rotation of the two support feet 13.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A plastic faucet body with copper connecting legs comprising:

a plastic member injection molded from plastic material and including two seat portions mounted on two sides thereof, a connecting portion defined between the two seat portions, and two support feet extending downwardly from two bottom ends of the two seat portions; each support foot having an inlet formed on a bottom end thereof and a channel arranged in the each support foot and communicating with each seat portion; the connecting portion having at least one exit defined on a middle section thereof and having a tunnel defined therein and communicating with the each seat portion;

two copper connecting legs made of cooper material, and each copper connecting leg being engaged on an outer wall of the each support foot of the plastic member and having a threaded section formed on the outer wall thereof; characterized in that:

a bottom end portion of the each copper connecting leg beyond a bottom end of the each support foot forms a distance so that between an inner fence of the each copper connecting leg and the bottom end of the each support foot is defined a receiving chamber for receiving a distal end of a cold water pipe or a distal end of a hot water pipe;

a lower coupling portion forms on a connection zone of the bottom end of the each support foot and the inner wall of the each copper connecting leg;

a groove communicates with the receiving chamber and connects with the lower coupling portion;

a seal element is retained with the groove so as to stop cold water from the cold water pipe or hot water from the hot water pipe flowing into the lower coupling portion; characterized in that the each support foot has a stepped fitting portion formed on a bottom end thereof; an outer fence of the stepped fitting portion and the inner fence of the each copper connecting leg define a part of the groove, and the lower coupling portion is located at a bottom fence of the groove.

2. The plastic faucet body with copper connecting legs as claimed in claim 1, characterized in that the seal element is an O ring made of rubber material, and the seal element has an external rim contacting with an outer fringe of the stepped fitting portion and has an external periphery retaining with the inner fence of the each copper connecting leg.

3. The plastic faucet body with copper connecting legs as claimed in claim 1, characterized in that the seal element has a plug portion and a lip fringe integrally extending outward from one end of the plug portion; the plug portion retains in the groove; the lip fringe abuts against a wall face of a distal end of the each support foot.

4. The plastic faucet body with copper connecting legs as claimed in claim 3, characterized in that at least one annular rib extends outwardly from an inner wall and an outer wall of the plug portion so that when the plug portion retains in the groove, the at least one annular rib contacts with the outer fence of the stepped fitting portion and the inner fence of the each copper connecting leg.

5. The plastic faucet body with copper connecting legs as claimed in claim 3, characterized in that the plug portion has a trough defined on a bottom end thereof.

6. A plastic faucet body with copper connecting legs comprising:

a plastic member injection molded from plastic material and including two seat portions mounted on two sides thereof, a connecting portion defined between the two seat portions, and two support feet extending downwardly from two bottom ends of the two seat portions; each support foot having an inlet formed on a bottom end thereof and a channel arranged in the each support foot and communicating with each seat portion; the connecting portion having at least one exit defined on a middle section thereof and having a tunnel defined therein and communicating with the each seat portion;

two copper connecting legs made of cooper material, and each copper connecting leg being engaged on an outer wall of the each support foot of the plastic member and having a threaded section formed on the outer wall thereof; characterized in that:

a bottom end portion of the each copper connecting leg beyond a bottom end of the each support foot forms a distance so that between an inner fence of the each copper connecting leg and the bottom end of the each support foot is defined a receiving chamber for receiving a distal end of a cold water pipe or a distal end of a hot water pipe;

a lower coupling portion forms on a connection zone of the bottom end of the each support foot and the inner wall of the each copper connecting leg;

a groove communicates with the receiving chamber and connects with the lower coupling portion;

a seal element is retained with the groove so as to stop cold water from the cold water pipe or hot water from the hot water pipe flowing into the lower coupling portion;

characterized in that the each support foot has a first slot formed on an inner wall of an inlet thereof and has a first increased conical notch connecting with a lower side of the first slot; the each support foot has a second increased conical notch defined on the inner fence of the each copper connecting leg so as to align with the first increased conical notch and has a second slot coupling with a lower side of the second increased conical notch; the first slot, the first increased conical notch, the second increased conical notch, and the second slot form the groove; the lower coupling portion forms on a connection zone of the first increased conical notch and the second increased conical notch.

7. The plastic faucet body with copper connecting legs as claimed in claim 6, characterized in that the seal element is made of rubber material and becomes increased downwardly and retains in the groove.

* * * * *